US008088468B2

(12) United States Patent
Maggio

(10) Patent No.: US 8,088,468 B2
(45) Date of Patent: Jan. 3, 2012

(54) EDGE GUARD FOR UNDERMOUNT SINKS

(76) Inventor: Anthony Michael Maggio, Washington, PA (US)

( * ) Notice: Subject to any disclaimer, the term of this patent is extended or adjusted under 35 U.S.C. 154(b) by 374 days.

(21) Appl. No.: 12/479,974

(22) Filed: Jun. 8, 2009

(65) Prior Publication Data

US 2009/0304986 A1 Dec. 10, 2009

Related U.S. Application Data

(60) Provisional application No. 61/131,550, filed on Jun. 10, 2008.

(51) Int. Cl.
*B32B 3/24* (2006.01)

(52) U.S. Cl. ..... 428/99; 428/136; 4/657; 4/655

(58) Field of Classification Search ..... 428/99; 4/657, 654, 655, 580, 581, DIG. 18; 248/345.1
See application file for complete search history.

(56) References Cited

U.S. PATENT DOCUMENTS 2,264,672 A * 12/1941 Levine ..... 4/580
5,671,583 A * 9/1997 Turner ..... 52/745.16
5,815,856 A 10/1998 Dore
6,338,171 B1 1/2002 Dandridge

* cited by examiner

*Primary Examiner* — Alexander Thomas
(74) *Attorney, Agent, or Firm* — David G. Oberdick; Peter J. Borghetti

(57) ABSTRACT

A protective cover for lining one or more edges of an undermount sink is provided. The protective cover has a means for removably attaching the cover to one or more interior ledges of the countertop adjacent to one or more sides of the sink, and is formed of a pliable material such as vinyl. In one embodiment, the protective cover is shaped to protect the edge of the countertop adjacent to the sink, without means for attachment to the countertop.

4 Claims, 3 Drawing Sheets

EDGE GUARD FOR UNDERMOUNT SINKS

CROSS-REFERENCE TO RELATED APPLICATION

This application claims priority under 35 U.S.C. §119(e) to provisional application Ser. No. 61/131,550, filed Jun. 10, 2008, hereby incorporated by reference in its entirety.

FIELD OF THE INVENTION

This invention relates to a removable cover to protect the inner edges of countertops surrounding an undermount sink and prevent chipping of countertop material.

BACKGROUND INFORMATION

Home builders, manufacturers of sinks and interior decorators agree that the undermount sink, when installed with a granite countertop, enhances the natural pattern and presentation of the stone and creates both a spectacular and functional addition to modern kitchens. Ironically, when the homeowner chooses to add this serious financial upgrade for its aesthetic characteristics, the only real inherent weakness in granite is revealed. Granite, being a stone, can be chipped. Although any area of the work surface can be marred with chips in the stone, the most vulnerable area for chipping is the exposed inner edge of the granite that surrounds the undermount sink. With the lesser stylish self-rimming or drop-in sink, the rim of the sink sits on top of this inner granite edge surrounding the sink; thus protecting it. The undermount sink is installed under the inner granite edge surrounding the sink. The exposed inner edge, especially in front of the sink, is highly vulnerable to chipping as the result of accidentally striking this edge with a heavy item while washing dishes. Although chips in the granite can be repaired, the process can be costly to the homeowner, and the repair is easily noticeable.

Various types of sink and/or counter protection devices are known. For example, U.S. Pat. No. 5,815,856 describes a protective mat for sinks and countertops. The mat covers the entire bottom and sides of the sink, and extends up onto the countertop.

U.S. Pat. No. 6,338,171 discloses a protective liner for sinks that is designed to cover the bottom and sides of the sink. This device also extends out of the sink onto the countertop.

Adhesive strips can be used to secure protective devices to the surfaces being protected, but these are prone to losing their adhesive properties over time. Additionally, devices which rely on adhesion for attachment are not easily removed when not in use. What is needed is an easily removable, aesthetically pleasing, edge guard or edge cover to protect the portion of the countertop which is most susceptible to chipping, such as the edge around the undermount sink.

SUMMARY OF THE INVENTION

Accordingly, the present invention provides a protective cover for lining one or more edges of a countertop having a sink disposed therein, the protective cover having a means for removably attaching the cover to one or more interior ledges of the countertop adjacent to one or more sides of the sink, and being formed of a pliable material.

BRIEF DESCRIPTION OF THE DRAWINGS

The invention is further illustrated by the following drawings in which.

DETAILED DESCRIPTION OF THE INVENTION

Figure 1:
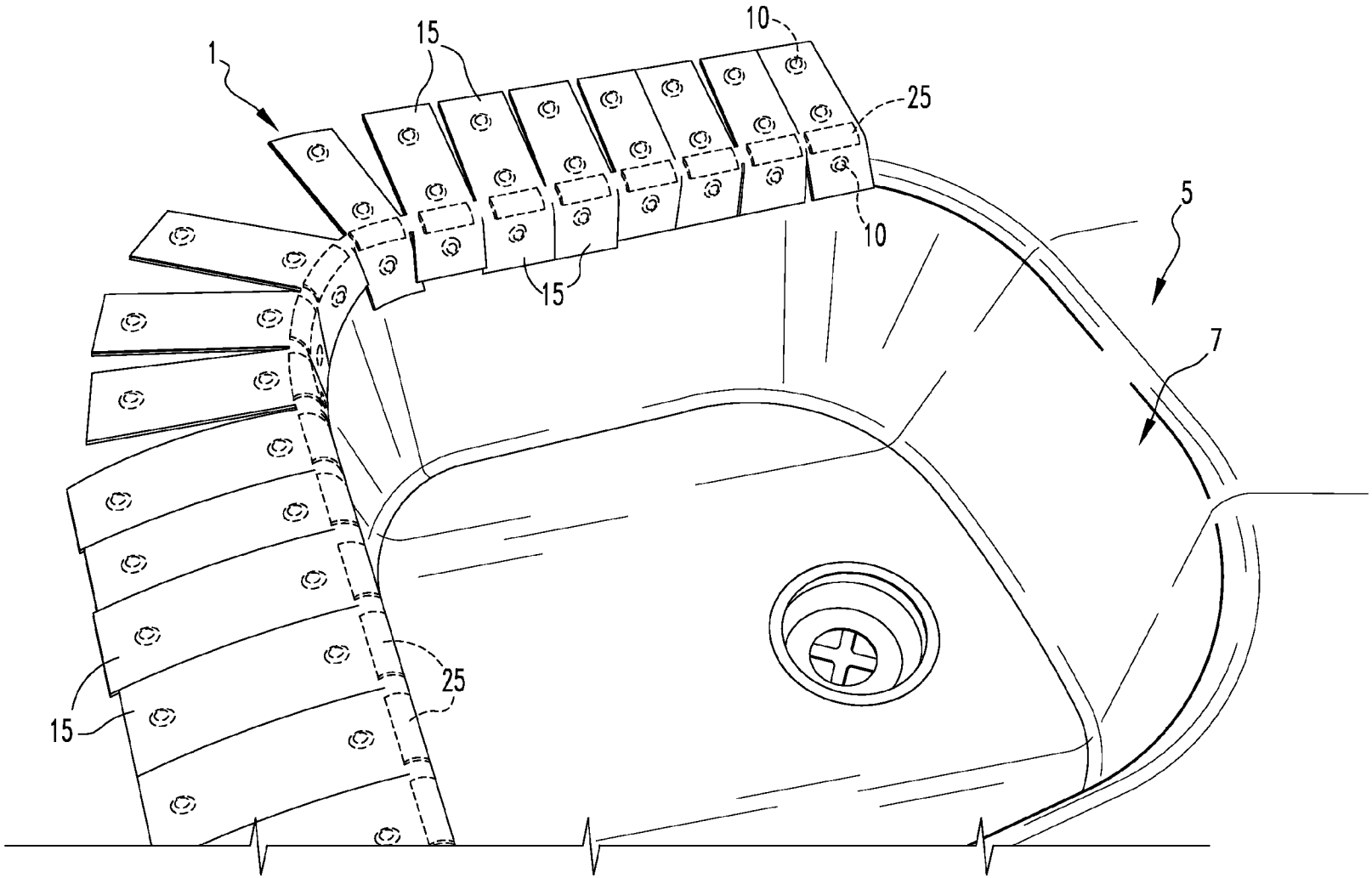
FIG. 1 is an embodiment of the edge guards of the present invention.
Figure 2:
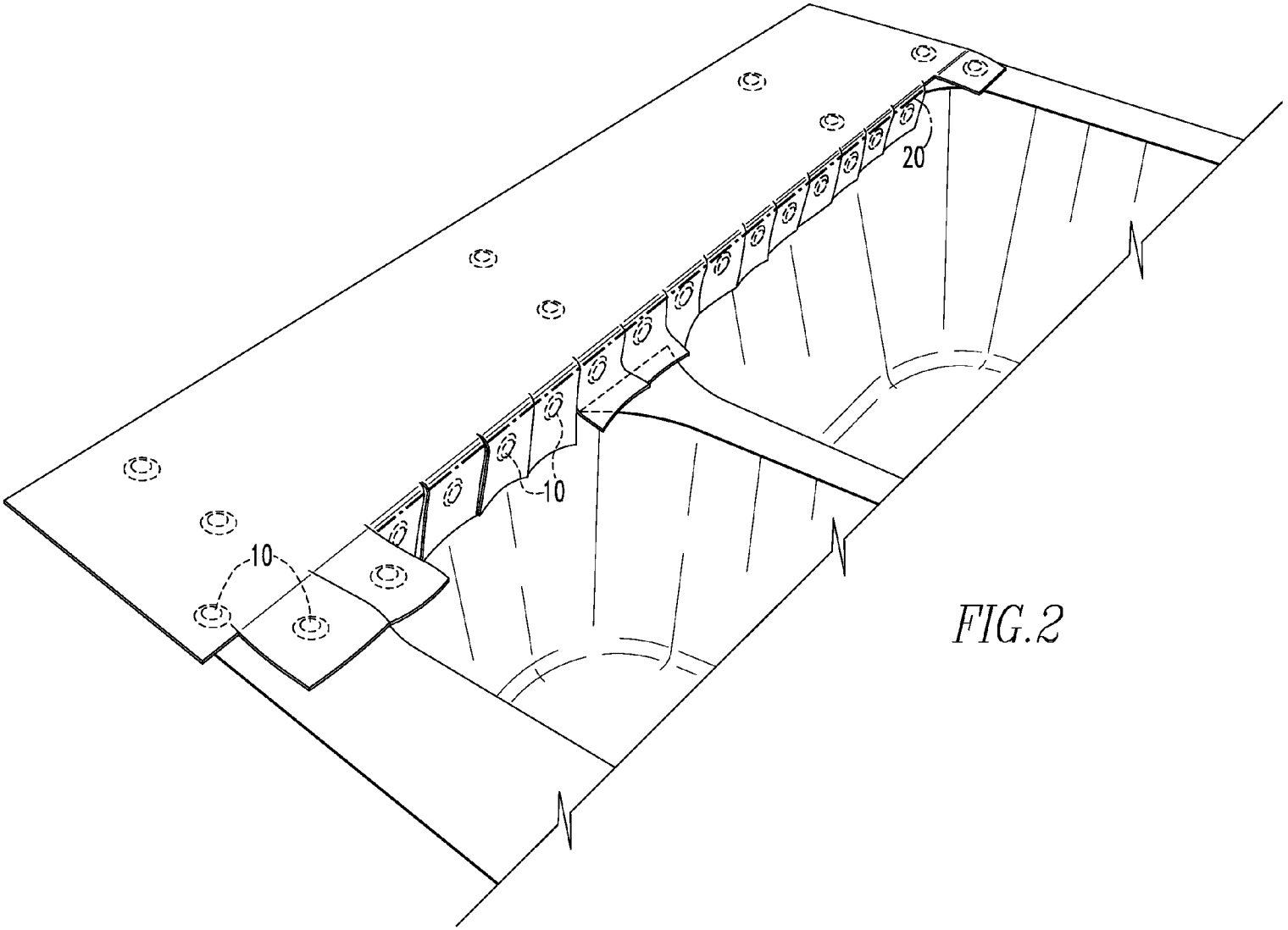
FIG. 2 is an additional embodiment of the present invention.
Figure 3:
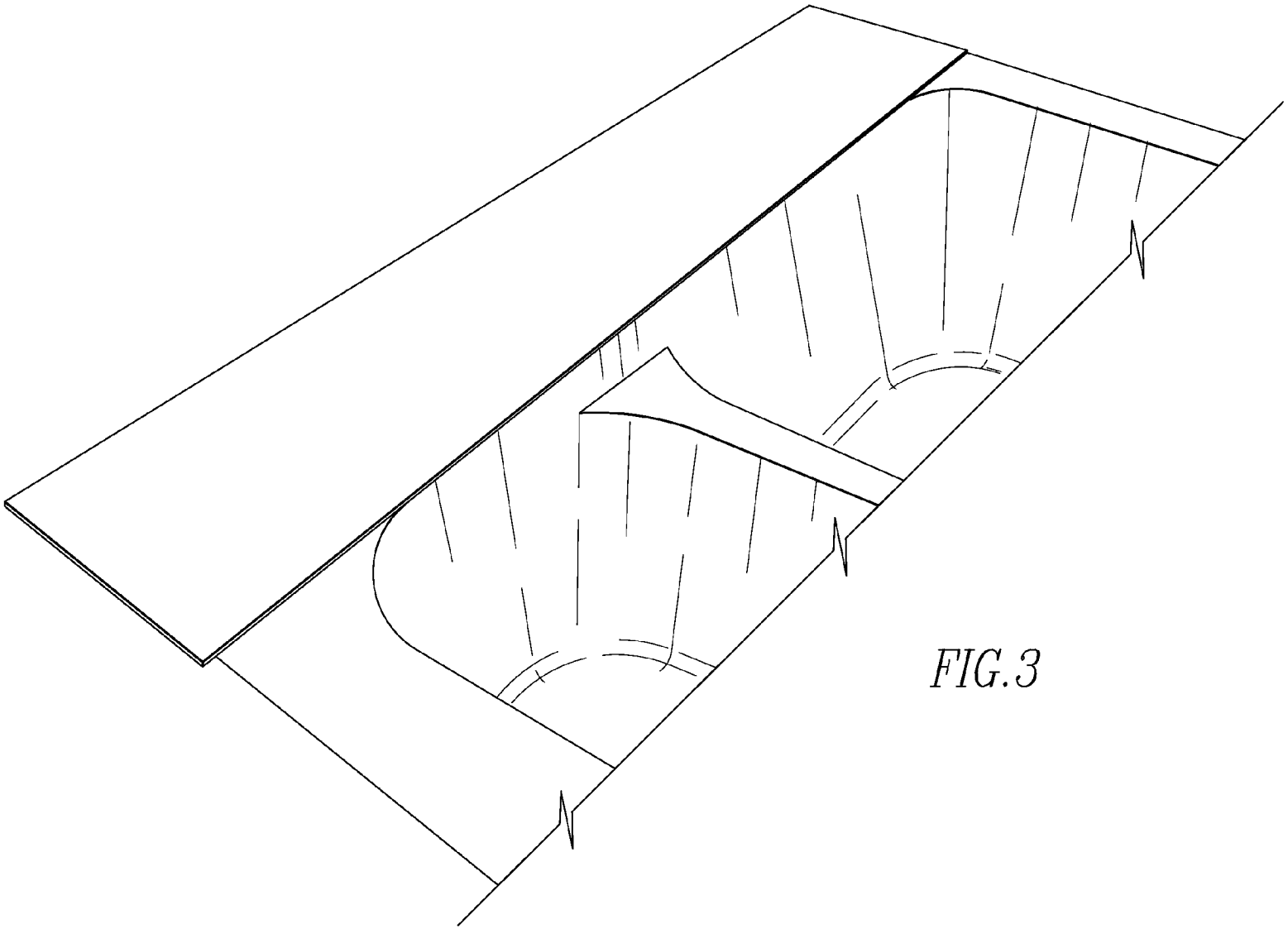
FIG. 3 is an additional embodiment of the present invention.

Referring to FIGS. 1-3, in one embodiment, the edge guard 1 of the present invention is made of a clear and flexible material such as vinyl or other soft plastic or rubber, and is shaped to overlay and attach to at least one edge of a countertop where the countertop 5 overhangs an undermounted sink 7. In one embodiment, the edge guard has a means for detachably fixing the guard to one or more interior ledges of the countertop adjacent to one or more sides of the sink, such as one or more suction pads 10 (FIGS. 1-2), on the back surface. In another embodiment, the edge guard does not require the attachment means (FIG. 3).

Optionally, the perimeter of the edge guard is sectioned into one or more folding flaps 15 to permit the edge guard to adapt to the shape of the sink installed (i.e. single bowl, double bowl, etc.), as shown in FIGS. 1-2. The folding flaps also serve to securely adhere the protective device to the interior ledge of the countertop, thus protecting the edge. Also optionally, the edge guard contains a reference line 20 to insure that the edge guard will be aligned with the inner edge of the countertop above the sink (FIG. 2). The reference line also allows the one or more folding flaps enough slack so that they securely adhere to the interior ledge of the countertop surrounding the undermount sink. In an additional embodiment, the edge guard is supplemented with one or more protective pads 25 placed on either side of the guard, preferably on the underside, to provide additional protection when a heavy item is accidentally dropped on the counter (FIG. 1). As would be understood by one skilled in the art, an edge guard of the present invention could have any combination of one or more features including protective pads, means for attachment and reference line.

In an embodiment where suction pads are used to secure the edge guard to the countertop surrounding the sink, the edge guard can be installed by wetting the countertop surface in front of the sink including the interior ledge under the edge of the countertop. The edge guard is placed on the countertop in front of the sink with the suction pads facing down and the individual folding flaps, when present, facing the sink. The edge guard is extended over the edge of the countertop by means of the reference line, when present. As many individual flaps as needed are folded over the countertop edge toward the sink. The flaps are affixed to the countertop ledge below the edge being protected by firmly depressing the suction pad under each flap to the interior ledge. Finally, the desired suction pads on the portion of the edge guard on the surface of the countertop in front of the sink are depressed. The edge of the countertop in front of the sink is now protected and accidental chipping due to heavy items slipping or glancing off the edge during the washing of dishes is less likely to occur. The edge guards of the present invention can be adapted to accommodate any shape of undermount sink to protect the edge of the countertop where it overhangs or is adjacent to the sink, such as square, rectangular, rounded and oval sink designs.

From time to time, a suction pad on one or more of the folding flaps affixed to the countertop ledge, below the portion of the edge being protected, may come loose, allowing the flap to loosen and flip up. Even in this position, the countertop edge is still protected. The homeowner needs to only wet the countertop ledge behind the loosened flap (s) and depress the suction pad (s) again.

With use of this device, the homeowner knows that the appearance of the costly granite will be better maintained and protected from the ugly pea-size chips that may occur every time dishes are washed. The homeowner's expense of installing an expensive surface such as granite can be largely safeguarded by a relatively inexpensive protective device.

A unique feature of the edge guards of the present invention is the detachable means for adhering the edge guard to the surface it is protecting. Suction pads securely hold the edge guard in place. Once the suction pads are depressed, the edge guard will remain fixed to the countertop until it is removed. The edge guard can be installed and removed in seconds. When not in use, it can easily be rolled and stored in the cabinet under the sink. For even more protection of the homeowner's investment, one or more additional edge guards can be cut to accommodate the countertop edge on additional sides of the sink.

Whereas particular embodiments of this invention have been described above for purposes of illustration, it will be evident to those skilled in the art that numerous variations of the details of the present invention may be made without departing from the invention as defined in the appended claims.

What is claimed is:

1. A protective cover for lining one or more edges of a countertop surrounding an undermount sink disposed therein, the protective cover comprising:

a strip being formed of a pliable material having a length and a width, wherein the length is greater than the width, and wherein the strip further comprises:

two longitudinal edges along the length of the strip;

a plurality of cuts along each longitudinal edge of the two longitudinal edges, wherein the plurality of cuts are oriented perpendicular to the each longitudinal edge of the two longitudinal edges;

wherein each cut of the plurality of cuts is less than the width of the strip to form a segment between longitudinally opposing cuts to form a plurality of foldable flaps; and a suction pad for removably attaching each foldable flap of the plurality of foldable flaps to an interior ledge of the countertop or to a side of the undermount sink.

2. The protective cover of claim 1, wherein the pliable material is selected from the group consisting of rubber, vinyl and plastic.

3. A protective cover for lining one or more edges of a countertop surrounding an undermount sink disposed therein, the protective cover comprising:

a strip being formed of a pliable material having a length and a width, wherein the length is greater than the width, and wherein the strip further comprises:

two longitudinal edges along the length of the strip;

a plurality of cuts along each longitudinal edge of the two longitudinal edges, wherein the plurality of cuts are oriented perpendicular to the each longitudinal edge of the two longitudinal edges;

wherein each cut of the plurality of cuts is less than the width of the strip to form a segment between longitudinally opposing cuts to form a plurality of foldable flaps;

a means for removably attaching each foldable flap of the plurality of foldable flaps to an interior ledge of the countertop or to a side of the undermount sink; and protective pads.

4. The protective cover of claim 3, wherein the pliable material is selected from the group consisting of rubber, vinyl and plastic.

* * * * *